United States Patent [19]

Michelson

[11] 4,174,549

[45] Nov. 20, 1979

[54] SOOT BLOWING APPARATUS

[76] Inventor: Herb Michelson, 5 Horizon Rd., Fort Lee, N.J. 07024

[21] Appl. No.: 844,859

[22] Filed: Oct. 25, 1977

[51] Int. Cl.[2] ..... F23J 3/02

[52] U.S. Cl. ..... 15/318; 15/312 R; 15/319

[58] Field of Search ..... 15/316 R, 317, 316 A, 15/318, 312 R, 319

[56] References Cited

U.S. PATENT DOCUMENTS

| | | | |
|---|---|---|---|
| 1,661,931 | 3/1928 | Dolan | 15/312 R X |
| 2,167,296 | 7/1939 | Farmer | 15/319 X |
| 2,350,929 | 6/1944 | Ridley | 15/316 R X |
| 3,739,421 | 6/1973 | Fukuba | 15/319 |
| 4,028,136 | 6/1977 | Kamp | 15/312 R X |

*Primary Examiner*—Christopher K. Moore

[57] ABSTRACT

A soot blowing system for cleaning banks or clusters of heat exchange tubes or the like contained in a furnace or flue housing comprising a movable platform carrying an apertured lance which is inserted sequentially into spaced openings in the wall of the furnace or flue housing so as to pass in proximity to the banks of the heat exchange tubes; the lance is directly connected to a flexible steam supply hose and is incrementally rotatable over a pre-determined area within the furnace or flue housing to steam clean the tubes in that area; upon withdrawal from the housing the platform and lance move to the next aperture in the housing where it is inserted and again incrementally rotated to clean that area of the tube bank.

15 Claims, 8 Drawing Figures

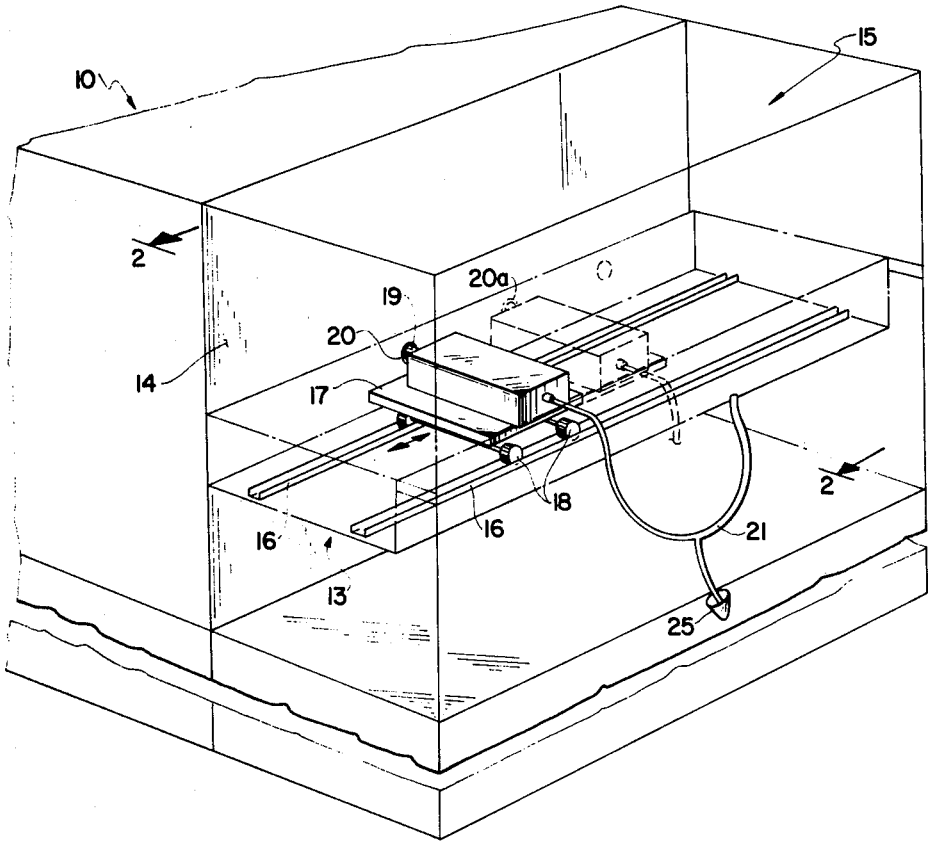

SOOT BLOWING APPARATUS

BACKGROUND OF THE INVENTION

This invention relates to the art involving cleaning devices which are used to remove deposits of soot, dirt and debris from heat exchange tube surfaces and particularly on the surfaces of tubes used in connection with furnaces and boilers. To remove such deposits, it has long been customary to use air or steam under high pressure to literally blow the deposits off the tubes and thus prevent the deposits from becoming a layer of insulation which would reduce the exchange or transfer of heat by the tubes and adversely affect their function. Such means are usually referred to in the trade as soot blowers.

The heat exchange tubes are customarily provided in banks or clusters. The hot combustion gases from the boiler or furnace pass over these banks of tubes which absorb the heat therefrom and thus heat the contents of each tube in the usual heat exchange function. In so doing, the exterior of the tubes collect dust or soot emitting from the furnace or boiler which makes the tubes less effective as heat exchange units unless thoroughly cleansed from time to time.

The problems involved in the deposit of dust or soot on or in heat exchange tubes have long been realized, and many attempts have been made to overcome these problems. Among these attempts are the structures set forth in the following U.S. Pat. Nos.: 1,677,383; 1,688,482; 1,760,589; 1,811,346; 1,896,565; 2,001,881; 2,112,896; 2,406,687; 2,696,016; 2,710,225; 3,049,738; 3,068,507; 3,138,819; 3,115,016; 3,184,774; 3,191,211; 3,436,786; 3,448,477; 3,794,051.

While, as aforesaid, many attempts have been suggested to overcome the problems, two structures are for the most part in commercial use.

One of the commercially used soot blowers utilizes a tube, called a lance, which extends across the width of the tube bank. The lance is provided with apertures or nozzles extending thereover at pre-determined spaced distances. High pressure steam is introduced into the lance and this steam emits through the various nozzles in order to enable jets of steam to pass therethrough and blow away the soot, dust and other debris. This device is usually provided with motor driven means disposed exteriorly of the furnace whereby the lance is continuously rotated through 360° continuing cycles thus attempting to blow the soot and debris away in a complete circle around the lance. This type cannot accommodate a flexible hose feed for the steam supply as it would become overly twisted and block the passage. Thus it was necessary to use seals between a rigid steam supply pipe and the rotating lance, and it also has been found that the soot blowing range of any one lance is very limited because the steam velocity decreases rapidly as it leaves each nozzle. Thus soot blowers of this type must be mounted in proximity to each other along the length of the bank of tubes which is a relatively costly arrangement.

In addition, such soot blowers have other disadvantages. Among them is the arrangement whereby the lances remain interiorly of the housing carrying the banks of tubes when not in use. Thus the lances are exposed to the condition or atmosphere of the hot corrosive flue gases at all times which causes the lance to deteriorate and necessitates eventual replacement of the lances or use of an expensive corrosion resistant alloy.

Furthermore, the lances, as aforesaid, are multi-nozzled or apertured. In fact, customarily, nozzles are provided every 8 to 12 inches along the length of the lance in order to assure its effectiveness. As this system is used in furnaces of varying widths including extremely wide furnaces, many nozzles are required. It has been found that in order to be effective, each jet nozzle requires a flow rate of thousands of pounds an hour to provide the high momentum needed to effectively clean the banks of tubes. Obviously, with the number of steam nozzles required per lance, it is necessary to install an expensive steam generator because of the high simultaneous capacity required. Since sootblowing is carried out for a small fraction of the time that the boiler or furnace operates, the expensive steam generating capacity is idle most of the time.

Another soot blower in current commercial use is one which also constantly rotates through 360° continuous cycles but is insertable and retractable. Such a soot blower is described in U.S. Pat. No. 2,696,016. In this device, a "lance" is also utilized but of a slightly different construction. This lance has two opposed nozzles at its terminus and rotates as it is advanced into the tube. The lance continuously rotates a full 360° in continuing cycles throughout the entire width of the tube bank. Furthermore, a reversing mechanism is provided to retract the lance after it reaches the end of its forward travel and it is brought back to a position outside of the housing containing the tube bank. Because there are only two jet nozzles, the steam generation capacity required is much smaller and there is a consequent saving in capital investment. In addition, the stored position of the lance outside of the furnace prevents it from becoming subject to the destructive effects of the hot corrosive flue gases.

However, the aforesaid construction has specific disadvantages. For example, a separate lance is required at predetermined spaced intervals along the length of the tube bank because the effective area which may be cleaned by the soot blower is quite limited extending only to about a 3 or 4 foot radius. In addition, there is a solid steam supply tube which is stationary and the lance rotates therearound. As a result, costly seals must also be provided in the construction between the rotating lance and its interior supply tube. As a result of the high pressure required in the steam supply, it has been found that no matter how effective the original seal, deterioration and steam leaks regularly develop and constant maintenance and expensive replacement is required.

The soot blower of the present invention overcomes the problems described above with regard to these commercial soot blowers presently provided and presents a unit which is extremely efficient while requiring only a minimum amount of parts and little maintenance while nonetheless effectively cleaning the surfaces of the tube banks in an extremely efficient manner.

SUMMARY OF THE INVENTION

The present invention provides a soot blowing system. Conceptually, it can utilize only one soot blowing lance which is carried by a carriage to transport it from station to station which immediately eliminates the need for multiple soot blowing lances.

Furthermore, the present invention contemplates the utilization of a step by step sequential cleansing operation in which there is no 360° continuous rotation of the lance around the supply tube and consequently there is no need for seals. In addition, the lance of the soot blower of the present invention uses only two nozzles and thus requires only a low steam generating capacity for cleansing purposes with the consequent large saving in steam generation capacity.

The present invention specifically provides a lance which is directly attached to a relatively elongate flexible hose. In one version the lance does not rotate or turn in any way while traveling into and through and steam cleaning an area of the aforesaid tube bank. In this version at the terminus of its original path of travel, the lance is turned about between 50° to 20° and is then gradually withdrawn from the tube bank housing while continuing to emit steam for cleansing purposes during the withdrawal operation. The flexible tube to which the lance is attached is also twisted between 5° to 20° in the step. At the end of the withdrawal sequence, which stops short of complete withdrawal from the housing, an area covered by an arc of between 5° to 20° on the tube banks above and below the lance have been cleansed. At this point, the lance is rotated or twisted an additional 50° to 20° in which position it re-enters the tube bank housing and steam continues to be emitted through the nozzles for cleansing in this additional area. At the terminus of this cycle of entry, the lance makes an additional 5° to 20° rotation or twist and withdrawn with steam emitting therefrom for cleansing thoroughly this additional arcuate area. As a result, these sequential operations at differing angles of steam emission ultimately provides a twisting up to about 180° by the lance which because of the presence of the two divergent emitting nozzles cleanses the entire area in the tube bank above and below the lance.

After the final pass of the lance to clean the tubes has been accomplished in a particular area, the lance is completely removed from the tube bank housing and the steam is shut off. The carriage arrangement utilized in the present invention moves the soot blower lance to the next station. While the lance and attached hose may be returned to its original straightened position before entering the next station, it is preferable that the lance and the hose remain in the "twisted" position upon entering the next port and then be rotated in a reversed direction or untwisted in sequential increments of about 5° to 20° as aforesaid in a direction reverse to the previous direction so that the flexible tube to which it is attached retraces its previous path of twisting cycle and finishes the second cycle in a straightened condition as it was at the starting position of the previous cycle.

While two nozzles are described in connection with this and the later version of the invention, it is obvious that a greater number may be utilized within the purview of the inventive concept or only one nozzle rotating sequentially an increment of about 360° may be used.

In another version of this invention, the lance enters the housing containing the tube banks but does not travel immediately to the other end of the tube bank. Instead, the lance enters the tube bank a relatively short pre-determined distance equivalent to the distance of the arc of 5° to 20° set forth above with its nozzles on a substantially horizontal plane. The travel of the lance is stopped and the lance is turned or twisted over an arc up to 180°. The apertures or nozzles have thus emitted steam over a sector of the banks above and below the lance. The lance is then moved forward another predetermined increment also equivalent to the distance of the aforesaid arc of from 5° to 20° and turned or twisted in a direction reverse to the direction of the previous turn or twist above described. As the steam is emitted through the apertures or nozzles, the next segment of tube banks above and below the lance is also cleaned. This step by step sequential procedure continues over the entire width of the bank tube area whereupon the lance is withdrawn and moved with the carriage to the next cleaning station. The lance is then reinserted into the housing and the above described sequential operation continues.

Thus the cleaning system of the present invention utilizes sequential stepped operations of slightly different form to accomplish the highly desirable result. The relatively rigid lance utilizes a flexible hose attached thereto by a clamp, or held by any other attaching means for the supply of steam because the approximate 180° twist required for the cycle in either version of the invention can be accommodated by the flexible hose without the requirement of any seal. This twist in no way blocks the passage in the hose. These aforedescribed cyclical steps are continued in each version throughout the entire tube bank area and thus cleansing of the entire tube bank is accomplished.

The invention therefore takes advantage of the flexibility of the elongate feed hose to which the lance is attached and which can without rupturing and blocking, turn or twist through the 180° position of rotation without deleterious effects and thereafter be returned sequentially in either version of the invention to its original position to effectively provide a total cleansing operation. The invention eliminates the necessity for multiple lances, continuous rotation, excessive steam generation, seals or any of the other disadvantages of previously utilized soot blowers.

The soot blower of the present invention accomplishes many other objects and provides distinct advantages which are described in detail in the accompanying specification.

SPECIFIC ILLUSTRATION OF THE INVENTION IN THE DRAWINGS

It is to be understood that the details set forth in the accompanying drawing and specification are not intended to limit the scope of the present invention but are merely used to illustrate a form thereof to enhance an understanding of the invention.

The drawings utilized to illustrate two embodiments of the present invention are as follows.

DETAILED DESCRIPTION OF THE INVENTION

Figure 1:
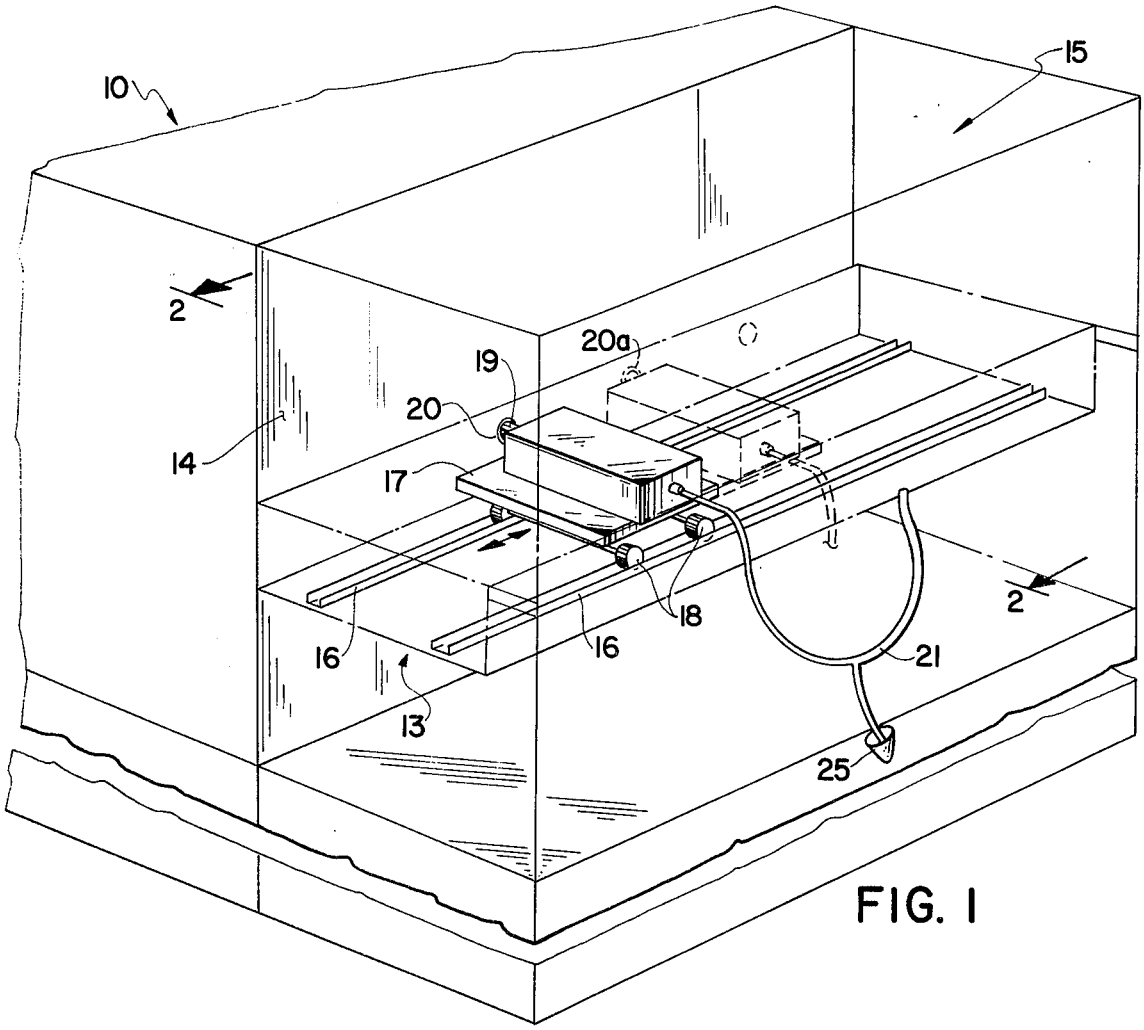
FIG. 1 is a perspective view of the apparatus of the present invention showing the means for conveying the soot blower lance and an illustrative steam supply area.

As illustrated in the drawings, there is shown a furnace or boiler area 10 though which hot flue or exhaust gases flow. This area is within the furnace or it can be located in an area adjacent thereto for heat exchange purposes as is well-known in the art. Tubes 11 are disposed within the housing 10 which comprises the furnace or flue area and are distributed in banks or clusters 12. Tubes 11 become covered with soot and other debris as a result of combustion in the furnace when in use. This soot and debris provide an undesirable insulating cover over the area and detracts from the conventional heat exchange function of the tubes. The system and apparatus of the invention provides a novel, relatively inexpensive and unique means for cleansing the tubes to remove the deposited soot and other debris and permit the tubes to perform their function.

In accordance with the invention, a movable cleansing system 13 is disposed adjacent to the housing 10 and is shielded therefrom by wall 14 extending between the compartment 15 carrying the system and the housing 10. The system 13 comprises a track 16 which carries a movable platform 17 on wheels 18 riding on track 16. Secured to the upper part of the platform is a lance 19 which travels with the platform along the track 16 to predetermined desired positions. These stop positions are located in each instance adjacent to one of the entry ports 20, **20*a*, etc., in the side wall 14 of the furnace or flue housing 10. The ports make accessible the clusters of tubes 11 disposed within the housing. When the movable cleansing system is located adjacent to the port 20, and the platform 17 comes to a stop, the lance 19 is automatically thrust through the port 20 into the interior of the furnace or flue housing 10**.

Figure 3:
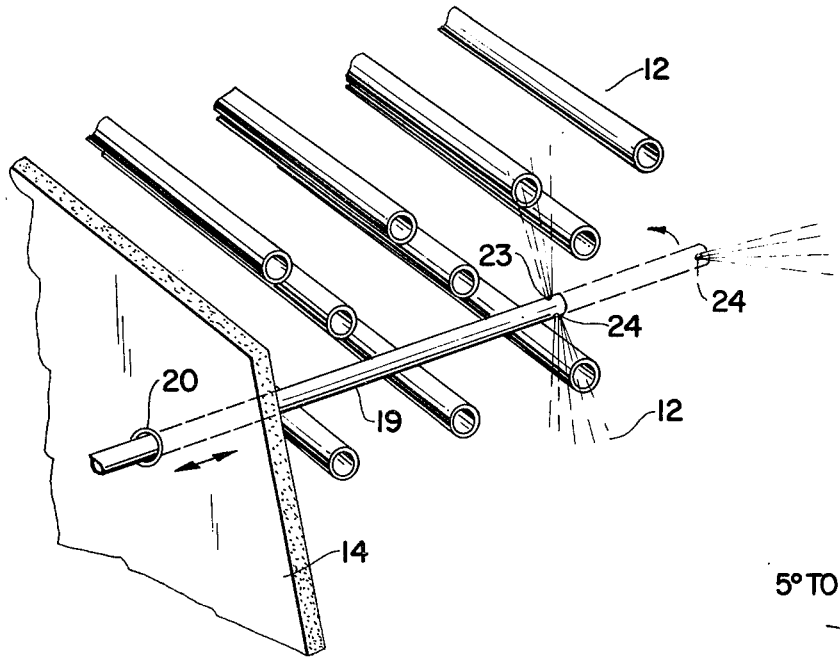
FIG. 3 is a perspective view showing the initial position of the lance in the furnace and, in dotted lines, a subsequent position of the lance in one area of the tube bank and also showing in dotted lines the twist of the lance as it reaches the terminus of its travel between the tube banks.

In the method of operation of the cleaning system of the present invention shown in FIGS. 3-6, the lance 19 is inserted into the housing through the port in the direction of the arrow shown in FIG. 3. The lance is substantially hollow and, as hereinafter set forth, is at predetermined times filled with steam under pressure from the flexible steam hose 21.

In accordance with the present invention, the lance 19 is directly connected to the flexible steam hose 21 by means of a clamp 22. While a clamp has been illustrated, it is to be understood that any suitable means for affixing the steam hose to the lance is within the purview of this disclosure. There is no extraneous or separate seal required between the lance 19 and the flexible hose 21 and the hose twists as the lance rotates. The lance 19 is preferably provided near its terminal end with two diagonally opposed apertures 23 and 24. The steam hose 21 is provided with a condensation hose ending in steam trap 25 to prevent condensation from entering the furnace which could cause damage to the walls 10.

As the lance is inserted into the housing 10, steam under pressure is admitted to the lance and is emitted from the lance through the diagonal apertures 23 and 24. This steam cleanses the arcuate area of tubes in the path of its emission. The arcuate area of the tube banks 12 which are cleansed may amount to that area which is covered by an arc of from almost 5° to 20° from each emitting point 23 and 24.

Figure 4:
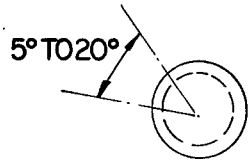
FIG. 4 is an end view of the lance showing the area covered by the twist of the lance at the terminus of its insertion between the tube banks.

In accordance with the invention, when the lance approximately reaches the side of the housing 10 opposite the port 20, it is automatically twisted approximately 5° to 20° in the direction of the arrow shown in FIG. 4 while steam is still constantly being emitted from the apertures 23 and 24. The lance is then in position for withdrawal movement and automatically begins the return while cleansing the area of the tube bank 12 adjacent the heretofore serviced area described with relation to the first pass. This cleansing operation affects an additional area covered by an arc between 5° to 20° during this second pass of the operation. The withdrawal movement of the lance 19 is automatically terminated prior to the time when the emitting apertures 23 and 24 reach port 20. At this position, the lance is again automatically stopped and rotated an additional 5° to 10° in the same direction as that of the first two passes. Forward movement of the lance in the direction of the arrow shown in FIG. 3 is again resumed thereby cleaning an additional area in the tube bank covered by an arc of from 5° to 20° from each aperture 23 and 24 by steam which is continuously emitted through these apertures.

Figure 5:
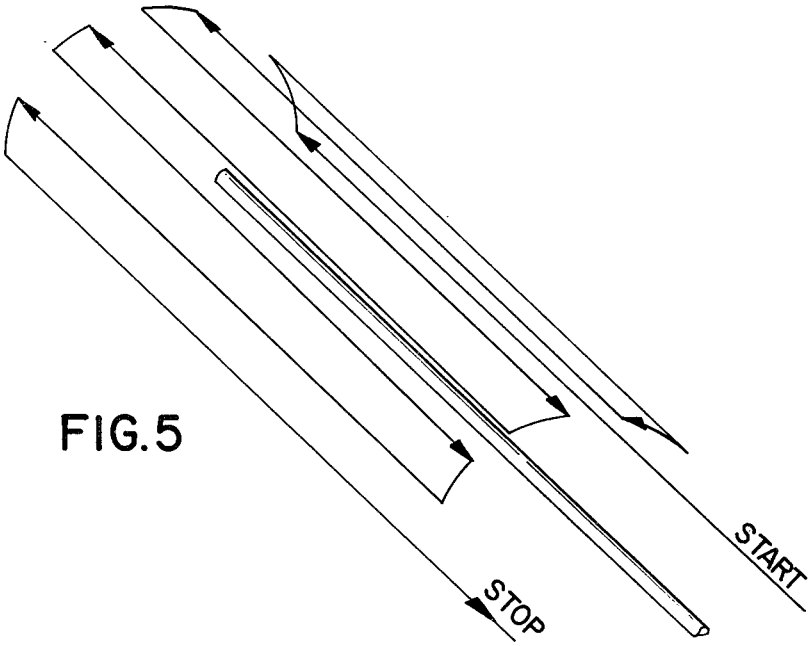
FIG. 5 is a diagramatic showing of the path of the lance in the sequence of operation illustrated in FIGS. 2 and 3 and showing the incremental twist of the lance through such sequence.

The sequential action of forward movement, arcuate rotation, withdrawal movement, arcuate rotation and forward movement, etc. continues throughout the pattern diagramatically set forth in FIG. 5 until each of the emitting apertures 23 and 24 shall have rotated approximately 180° while the lance remains within the housing adjacent port 20. Thus, a complete 360° area is cleansed by the emitting steam in this thrust of the lance 19 from the cleansing system 13. As a consequence, the steam hose supplying the steam to the lance will also be twisted only 180° during this operation which, in view of the length of the hose, has no deleterious or adverse effect.

At the terminus of the aforedescribed sequence of operations, the lance is totally withdrawn from the port hole 20 at which time the supply of steam to the lance is automatically discontinued. The platform or carriage 17 is then automatically moved along the track to the next adjacent port hole **20*a* where an automatic stop terminates movement of the carriage 17. In this second position the lance is automatically reinserted into this next adjacent port hole 20*a* and the cleansing cycle is continued. However, in accordance with the invention, the operative sequence does not follow the diagramatic arrangement set forth in FIG. 5 but instead provides an oppositely turning sequence. The 5° to 20° increments of turn in rotation of the lance are in a direction opposite to the direction of rotation set forth with regard to the first thrust and thus opposite to the direction of the arrows in FIG. 5. As the insertion, turning, withdrawal, turning, insertion sequence continues, the steam hose 21** attached to the lance for its steam supply is untwisted and returns to its normal straight position. As a consequence, in accordance with the present invention, the hose need never be twisted over an arc comprising more than approximately 180° while nevertheless accomplishing all of the desired cleansing operations over the entire area of the tube bank in sequential passes entering each port hole in turn.

When the lance is totally retracted, it is withdrawn into the soot blower carrier and the hinged door 26 closes to cover the port 20 and prevent the flow of gases in and out of the furnace in flue area 10.

The aforesaid arrangement completely prevents any blockage of the passage of steam which might result from any overtwisting of the supply hose and as a result of the incremental arcuate rotation. There is little, if any, need for replacement of parts and the system can operate efficiently over indefinite periods of time. The steam generation capacity is small since only two apertures are used. Obviously only one lance would be required to service the entire length of even a huge tube cluster housing area. In addition, there are no extraneous seals necessary because there is no 360° continuous rotation of the lance around the supply tube. In fact, the 180° twist can be easily accomplished with little stress or strain on the steam hose supply. Thus, a novel and efficient method and system has been provided to overcome the long standing problem of efficiently and economically cleansing heat exchange tubes in the path of hot flue gases. It is understood that as a result of the above concept, the steam emitting sequence of the lance can be so timed that steam is emitted only when heat exchange tubes are in the path of the aperture from the lance. Thus, in the illustration shown in FIG. 3, no steam need be emitted from the lance when the apertures 23 and 24 are on a substantially horizontal plane as opposed to those vertical planes in which the tube banks 12 would be in the path of the emitted steam.

Furthermore, in accordance with the invention, the lance need not be removed from port 20 and inserted in port 20*a* before it is rotated to untwist the steam hose 21. In other words, either prior to or during its withdrawal from port 21, the lance may be automatically rotated in a direction opposite to the incremental rotation shown in FIG. 5 so that the hose is untwisted and straightened before it enters port 20*a*. Upon entry into port 20*a*, it will thereupon be understood that the lance can again rotate in the sequential steps shown in FIG. 5 or alternatively rotate sequentially in the opposite direction.

While a double apertured lance has been shown, it is understood that the lance may have a single aperture and be rotated over 360° in the 5° to 20° increments as such rotation will not twist the elongate steam hose 21 in such fashion as to prevent it from appropriately functioning. The sequential steps described above would be repeated. However, the rotation of the lance would pass through 360° with the steam being emitted when necessary to clean the tube banks in the path of the lance aperture or whenever desired.

Figure 2:
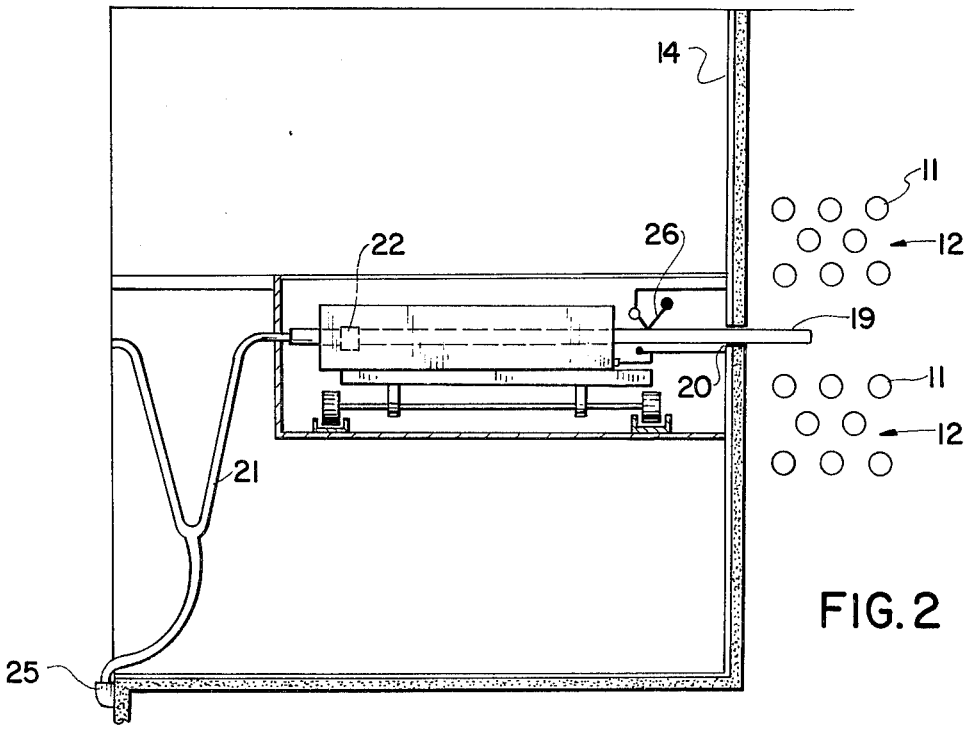
FIG. 2 is a sectional view taken along the lines 2—2 of FIG. 1 and showing in dotted lines the direct connection between the lance and the steam supply hose.
Figure 6:
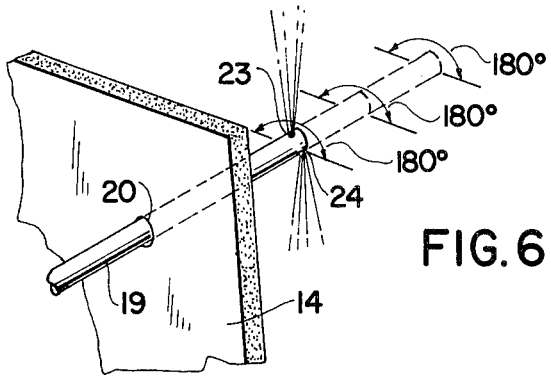
FIG. 6 is a perspective view of a modified form of incremental cleansing accomplished by the apparatus of the present invention showing in dotted lines the rotational twist of the lance throughout the tube bank.
Figure 7:
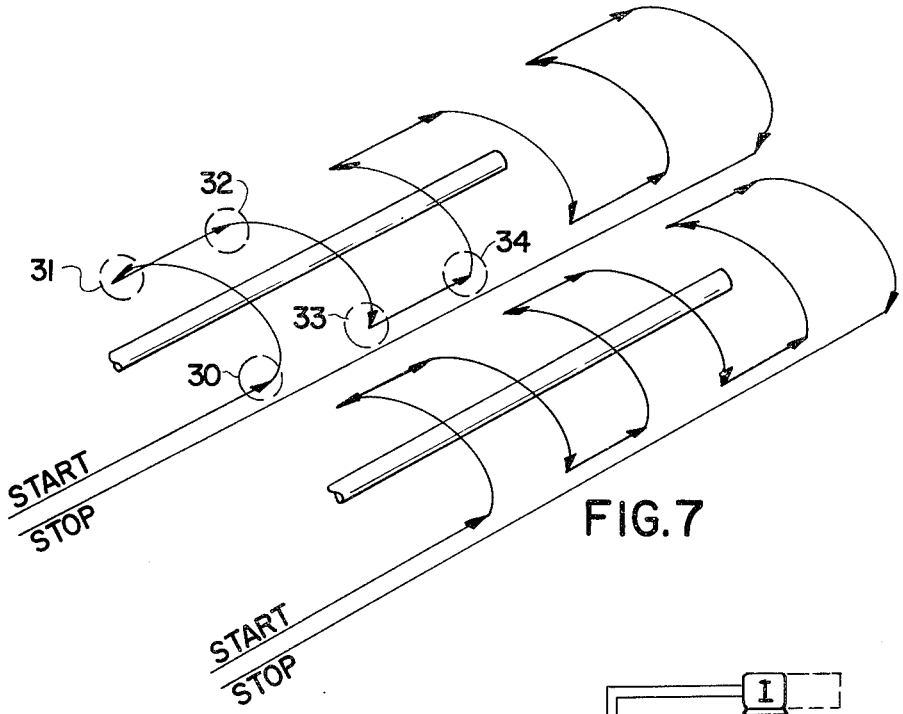
FIG. 7 is a diagramatical view of the incremental twist of the lance through the sequence of operation illustrated in FIG. 6.

A modified form of the inventive concept is illustrated in FIGS. 6–7. FIG. 6 shows the lance structure inserted into the port hole 20 in the wall 14 of the housing 10. The lance is carried by the same type platform 17 riding on tracks and has the same steam hose arrangement as the structure illustrated in FIGS. 1 and 2. In the modified form, however, the lance 19 is inserted into the housing 10 to a lesser extent in the first portion of the thrust than the extent of the insertion in FIGS. 3–5. As illustrated in FIG. 7 the thrust extends from the "start" position to position 30. The lance at this point is then rotated approximately a full 180° to position 31 shown in FIG. 7 which cleanses the tube banks in a 360° area in the vicinity of the lance itself because the two emitting apertures 23 and 24 each rotates 180°. The lance is then automatically inserted further into the housing to position 32 in FIG. 7 where it is rotated 180° in the direction of the sequential arrow which is reverse to that of the rotation between position 30 and 31. When the lance has made this rotation to position 33, it is again moved forward into the housing to position 34 and rotated in the same direction as the rotation accomplished between positions 30 and 31, as is indicated by the arrow.

The aforesaid sequential operation continues through the entire path of the lance insertion into the housing as diagramatically illustrated in FIG. 7 until it reaches approximately the wall of the housing opposite the port 20. At this position, the lance makes its final 180° arcuate sweep and then is automatically withdrawn from the housing whereupon the steam feed is automatically stopped. Thus, a complete cleansing operation takes place within the housing in the area covered by this thrust of the lance through the complete 360° in proximity to the lance as it progresses inwardly.

The lance is then carried forward on the carriage 17 to port 20*a* were it is again inserted into the housing and the sequence described hereinbefore and shown in the diagrammatic illustration in FIG. 7 is repeated. The sequential operation continues until the entire bank of tubes is cleansed from the debris and soot and maintained in functioning and operational condition. As a consequence, in this operation the steam hose is not twisted by any increment exceeding approximately 180°. Further, there is little stress or strain and all of the benefits described with reference to the form of the invention shown in FIGS. 3–5 are accomplished and obtained by this modified form.

It is to be noted that increments of travel of the lance into the furnace area 10 between points 31–32, 33–34, etc., are substantially equivalent of the distance covered by the 5° to 20° incremental rotation of the lance as shown in FIGS. 4 and 5. This accomplishes a total cleansing of the tube area in a highly efficient manner. It is also to be understood that steam may be emitted from the lance only at such times when tube banks 11 are in the path of the apertures 23 and 24 in order that energy be conserved.

Figure 8:
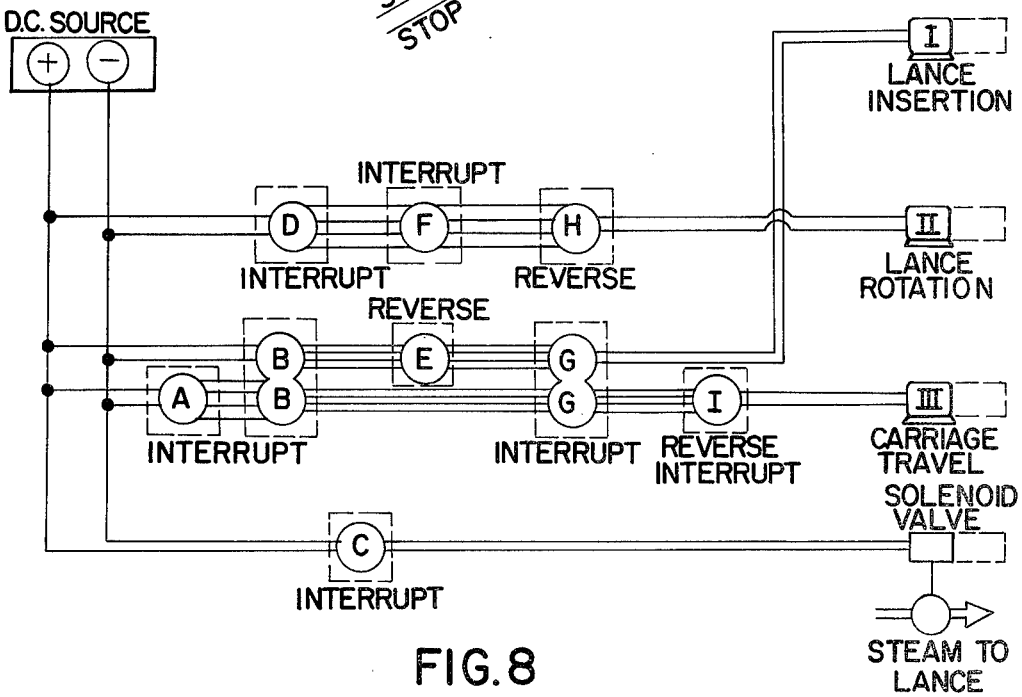
FIG. 8 is a schematic view illustrating one form of a block wiring diagram to accomplish the various sequential steps of the cleansing operation of the apparatus shown in FIGS. 1-5.

FIG. 8 is a simplified diagramatic disclosure of the electrical arrangemennt including the motors and switching structure utilized in connection with the invention herein described in FIGS. 1–5. Three motors may be involved as follows:

Motor I—for the travel of the lance in and out of the tube bank; and

Motor II—for the sequential rotation of the lance; and

Motor III—for transporting the carriage along the tracks outside of the furnace housing.

All three motors are essentially standard Direct Current motors so that when the polarity of the current to the motor is reversed, the motor turns in the opposite direction. Also, since the motors have a gear drive, only a fraction of a horsepower each is required for the necessary functions.

Each motor is supplied current through a number of switches. These switches are multiple pole, double throw. They are capable of performing one or both of the following two functions, depending on the way they are wired:

1. Reverse the polarity of the current to a motor.
2. Interrupt the flow of current to a motor until another switch in the circuit is actuated. This is similar to the multi-switch home light circuit where any one switch when actuated changes whether current is flowing to the light bulb or not.

The cycle set forth with relation to the illustrated form of the invention in FIGS. 1-5 is started by actuating switch A (interrupt) which is mounted anywhere convenient to the operating personnel. This supplies current to the carriage travel Motor III. The carriage travels until it reaches the first sootblowing station, a position where switch B (interrupt) engages a striker-plate. Switch B interrupts the current to Motor III and starts the current to Motor I propelling the lance into the furnace. After the head of the lance is in the furnace, switch C (interrupt) is actuated which opens the solenoid valve admitting the blowing medium to the lance. Just immediately before the end of the inward stroke, switch D (interrupt) is actuated which will start the rotation Motor II. Just after that, switch E (reverse) is actuated which reverses the lance travel. Then switch F (interrupt) is actuated which stops the rotational travel of Motor II. The lance then is withdrawn from the furnace and properly positioned stops rapidly actuate switches D, E and F so that the lance is traveling inward again after a slight rotation. After completing an in and out cycle covering almost 180° the lance travels outward from the furnace. There are no stops located in the path of the outgoing lance to activate any of the switches which had previously been used to reverse and rotate the lance. As the lance is withdrawn, switch C is activated, stopping steam flow. Once the lance is withdrawn from the furnace, a striker plate on the lance actuates switch G thereby causing motor I, which was operating to move the lance 19 outward from the furnace area 10, to stop and starting motor III. The carriage 17 is thereupon moved until it reaches the next sootblowing position where a striker plate has been positioned to reactuate switch B which stops motor III and starts motor I. The lance continues its outward movement and immediately thereafter engages a striker plate to actuate switch E and reverse the lance travel so that it begins to move through the port 20*a* and inwardly of the furnace 10. That striker plate also actuates switch H which reverses the polarity of the current to motor II. In this manner, when the lance reaches the end of its inward movement it will rotate sequentially in a direction opposite the direction of the prior rotational sequences. The aforedescribed series of sequential operations continues until all the soot-blower stations behind each port hole has been serviced. When this is accomplished, the carriage travel motor III will begin to carry the carriage past the last sootblower station whereupon it contacts a striker plate which engages switch I which serves to simultaneously interrupt the current and reverse the polarity thereof in preparation for the next cycle wherein the carriage will traverse the furnace in the direction opposite to the afore-described direction of travel.

It is to be understood that the wiring schematics are merely illustrative of one means for carrying out the basic concepts of the present invention which provide a novel and unique system and method for overcoming problems of great concern in connection with the use of energy saving devices such as heat exchangers without requiring the expenditure of enormous energy for this purpose. Also, the result is accomplished without necessitating the use of expensive and complicated machinery. In effect, a continuous maintenance of the energy saving devices is accomplished efficiently by the incremental and toatal cleansing described in this specification.

It is to be understood, however, that this description is merely to effect a complete understanding of the invention and the inventive concept and is in no way intended to limit the scope of the invention as defined in the appended claim.

I claim:

1. A soot blowing system for cleaning banks of tubes or the like disposed in an apertured housing having a plurality of insertion apertures comprising:

a moveable carriage located exteriorly of said housing, an apertured lance having an apertured portion containing at least one fixedly positioned emission opening, means for rotatably and axially displacing said lance relative to said moveable carriage for sequential insertion of said lance into and rotation within said insertion apertures in the housing to pass in proximity to said banks of tubes, and means for connecting said lance to a fluid supply, said lance being rotatable about its own axis to emit fluid under pressure through its apertured portion for cleaning the tubes in the adjacent spatial area of the emission of the fluid.

2. A soot blowing system for cleaning banks of tubes or the like disposed in an apertured housing having a plurality of insertion apertures comprising:

a moveable carriage located exteriorly of said housing, an apertured lance having an apertured portion containing at least one fixedly positioned emission opening, said lance being rotatably and axially displaceably carried by said moveable carriage for sequential insertion into and rotation within said insertion apertures in the housing to pass in proximity to said banks of tubes, and means for connecting said lance to a fluid supply, said lance being rotatable about its own axis to emit fluid under pressure through its apertured portion for cleaning the tubes in the adjacent spatial area of the emission of the fluid, the apertured lance having two substantially diametrically opposed openings for the passage of fluid therethrough, and the blowing system including means for automatically moving said carriage from one insertion aperture in the housing to another insertion aperture in the housing and for automatic sequential insertion of said lance into and rotation within said apertures in the housing.

3. The soot blowing system of claim 2 including hingedly mounted cover means for covering the insertion apertures in said apertured housing and arranged for uncovering such insertion apertures in response to insertion movement of the lance.

4. The soot blowing system of claim 1 in which the fluid is steam and the means for connecting the lance to the fluid supply includes a flexible steam supply hose of selective length to which the lance is directly connected whereby the hose twists as the lance rotates, the length of the hose being sufficient to accommodate such twisting therealong.

5. A soot blowing system for cleaning banks of tubes or the like disposed in an apertured housing having a plurality of insertion apertures comprising:

a moveable carriage located exteriorly of said housing, an apertured lance having an apertured portion containing at least one fixedly positioned emission opening, said lance being rotatably and axially displaceably carried by said moveable carriage for sequential insertion into and rotation within said insertion apertures in the housing to pass in proximity to said banks of tubes, and means for connecting said lance to a fluid supply, said lance being rotatable about its own axis to emit fluid under pressure through its apertured portion for cleaning the tubes in the adjacent spatial area of the emission of the fluid, the fluid being steam, the means for connecting the lance to the fluid supply including a flexible steam supply hose of selective length to which the lance is directly connected whereby the hose twists as the lance rotates, the length of the hose being sufficient to accommodate such twisting therealong, and further including means for automatically sequentially inserting and withdrawing said lance into and out of said apertured housing whereby steam emitting from said lance cleans the banks of tubes in proximity to the openings in said lance.

6. The soot blowing system of claim 5 including means for selectively incrementally rotating said lance over a pre-determined path through a corresponding spatial area during the time when the lance is inserted in proximity to the banks of tubes.

7. A soot blowing system for cleaning banks of tubes disposed in an apertured housing having a plurality of insertion apertures comprising:

an apertured lance, means for rotatably displacing said lance on an independently moveable carriage for rotation of said lance relative to said carriage, a flexible fluid supply hose having a freely disposed and displaceable connection end portion of sufficient length to accommodate twisting thereof therealong, and means for directly connecting said lance to the connection end portion of said flexible fluid supply hose whereby when said lance is rotated the connection end portion of the hose is correspondingly twisted.

8. A soot blowing system for cleaning banks of tubes or the like disposed in an apertured housing having a plurality of insertion apertures comprising:

a moveable carriage located exteriorly of said housing;

an apertured lance rotatably and axially displaceably carried by said moveable carriage for sequential insertion into said insertion apertures in the housing to pass in proximity to said banks of tubes;

means for connecting said lance to a fluid supply hose, said lance being rotatable about its own axis on the carriage to emit fluid under pressure through its apertured portion for cleaning the tubes in the adjacent spatial area of the emission of the fluid;

means for automatically inserting said lance into one insertion aperture of said apertured housing;

means for automatically moving the inserted lance selectively axially along a substantially horizontal plane while disposed within the housing from one side of the housing to the other;

means for automatically incrementally rotating said lance over a pre-determined path through a corresponding spatial area when said lance is moved into proximity with one side of said housing to accomplish a first cleaning operation; and means for automatically withdrawing said lance from the one insertion aperture of said housing.

9. The soot blowing system of claim 8 including means for automatically moving said carriage along a substantially horizontal plane from the one insertion aperture to another insertion aperture in said apertured housing.

10. The soot blowing system of claim 9 in which the means for incrementally rotating said lance are arranged for incremental rotation of said lance in one direction during said first cleaning operation whereby to permit the thereby rotated lance to be withdrawn from the one insertion aperture in such housing for inserting the thereby rotated lance into said another insertion aperture upon movement of said carriage with said means being further arranged for incremental rotation of the thereby rotated lance in a direction opposite the direction of rotation during said first cleaning operation when said lance is inserted into said another insertion aperture in said housing for another cleaning operation.

11. The soot blowing system of claim 10 in which the incremental rotation of the lance extends in an arc of between approximately 5° to 20°.

12. The soot blowing system of claim 10 in which the incremental rotation of the lance in the opposite direction extends in an arc of between approximately 5° to 20°.

13. A soot blowing system for cleaning banks of tubes or the like disposed in an apertured housing having a plurality of insertion apertures comprising:

a moveable carriage located exteriorly of said housing;

an apertured lance rotatably and axially displaceably carried by said moveable carriage for sequential insertion into said insertion apertures in the housing to pass in proximity to said banks of tubes;

means for connecting said lance to a fluid supply hose, said lance being rotatable about its own axis on the carriage to emit fluid under pressure through its apertured portion for cleaning the tubes in the adjacent spatial area of the emission of the fluid; and means for automatically injecting said lance into one insertion aperture of said apertured housing, and for automatically incrementally moving the inserted lance along a substantially horizontal plane while disposed within said housing from one side of said housing to the other, and for automatically rotating said lance in one direction over a predetermined path through a corresponding spatial area after the first incremental substantially horizontal movement of said lance within said housing to accomplish a first cleaning operation before the next incremental substantially horizontal movement of said lance within the housing, and for automatically incrementally moving said lance a predetermined further distance along a substantially horizontal plane after said first cleaning operation, and after completing such further distance for automatically rotating said lance over a pre-determined path through a corresponding spatial area in a direction opposite the direction of rotation during said first cleaning operation to accomplish another cleaning operation, and for automatically withdrawing said lance from the one insertion aperture of said housing.

14. The soot blowing system of claim 13 including means for automatically moving said carriage along a substantially horizontal plane from the one insertion aperture to another insertion aperture in said apertured housing.

15. The soot blowing system of claim 13 in which the incremental rotation of the lance extends in an arc of approximately 180°.

* * * * *